US010308028B2

(12) United States Patent
Ueno

(10) Patent No.: US 10,308,028 B2
(45) Date of Patent: Jun. 4, 2019

(54) WASTE INK STORAGE MECHANISM AND INKJET RECORDING DEVICE INCLUDING SAME

(71) Applicant: KYOCERA Document Solutions Inc., Osaka (JP)

(72) Inventor: Daijiro Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/987,536

(22) Filed: May 23, 2018

(65) Prior Publication Data

US 2018/0345672 A1 Dec. 6, 2018

(30) Foreign Application Priority Data

Jun. 1, 2017 (JP) ..... 2017-109421

(51) Int. Cl.
*B41J 2/17* (2006.01)
*B41J 2/165* (2006.01)
*B41J 2/175* (2006.01)

(52) U.S. Cl.
CPC ..... *B41J 2/1721* (2013.01); *B41J 2/16523* (2013.01); *B41J 2/16538* (2013.01); *B41J 2/16552* (2013.01); *B41J 2/175* (2013.01); *B41J 2002/16558* (2013.01); *B41J 2002/1728* (2013.01)

(58) Field of Classification Search
CPC .. B41J 2/1721; B41J 2/16523; B41J 2/16538; B41J 2/16552; B41J 2/175
See application file for complete search history.

(56) References Cited

U.S. PATENT DOCUMENTS 6,062,667 A * 5/2000 Matsui ..... B41J 2/17503 347/19
6,220,314 B1 * 4/2001 Sato ..... B41J 2/16523 141/100
6,375,305 B2 * 4/2002 Sugimoto ..... B41J 2/16523 347/36
7,976,121 B2 * 7/2011 Harada ..... B41J 2/16523 347/31
8,152,273 B2 * 4/2012 Osumi ..... B41J 2/16523 347/36
8,297,734 B2 * 10/2012 Harada ..... B41J 2/16517 347/31

(Continued)

FOREIGN PATENT DOCUMENTS

JP 2004-130701 A 4/2004

*Primary Examiner* — Lamson D Nguyen
(74) *Attorney, Agent, or Firm* — Stein IP, LLC

(57) ABSTRACT

A waste ink storage mechanism of the present disclosure includes a waste ink tank, a waste ink tank fitting portion and a capacitance sensor. The waste ink tank stores a waste ink exhausted from a recording head. The waste ink tank is fitted to the waste ink tank fitting portion such that the waste ink tank can be fitted into and removed from the waste ink tank fitting portion. The capacitance sensor is provided in the waste ink tank fitting portion so as to detect that a liquid surface within the waste ink tank reaches a predetermined level. The waste ink tank includes: a first surface in which an inflow port through which the waste ink flows in is formed; and a second surface, and the capacitance sensor is arranged close to the second surface.

11 Claims, 7 Drawing Sheets

(56) References Cited

U.S. PATENT DOCUMENTS

| | | | | |
|---|---|---|---|---|
| 8,353,573 | B2 * | 1/2013 | Osumi | B41J 2/16523 347/36 |
| 8,353,585 | B2 * | 1/2013 | Harada | B41J 2/1721 347/36 |
| 8,602,522 | B2 * | 12/2013 | Harada | B41J 2/1721 347/36 |
| 9,132,644 | B2 * | 9/2015 | Harada | B41J 2/1721 |
| 9,168,756 | B2 * | 10/2015 | Harada | B41J 2/1721 |
| 9,227,407 | B1 * | 1/2016 | Harada | B41J 2/16517 |
| 9,227,409 | B2 * | 1/2016 | Takano | B41J 2/16508 |
| 9,266,333 | B2 * | 2/2016 | Harada | B41J 2/16517 |
| 9,375,935 | B2 * | 6/2016 | Harada | B41J 2/16517 |
| 2004/0075712 | A1 | 4/2004 | Ono | 347/36 |
| 2007/0065166 | A1 * | 3/2007 | Takiguchi | G03G 21/12 399/35 |
| 2009/0218270 | A1 * | 9/2009 | Harada | B41J 2/1721 210/236 |
| 2009/0219338 | A1 * | 9/2009 | Harada | B41J 2/1721 347/36 |
| 2009/0219339 | A1 * | 9/2009 | Harada | B41J 2/1721 347/36 |
| 2012/0236074 | A1 * | 9/2012 | Harada | B41J 2/1721 347/36 |
| 2016/0114589 | A1 * | 4/2016 | Harada | B41J 2/16517 347/36 |
| 2016/0303854 | A1 * | 10/2016 | Matsuura | B41J 2/16508 |

* cited by examiner

WASTE INK STORAGE MECHANISM AND INKJET RECORDING DEVICE INCLUDING SAME

INCORPORATION BY REFERENCE

This application is based upon and claims the benefit of priority from the corresponding Japanese Patent Application No. 2017-109421 filed on Jun. 1, 2017, the entire contents of which are incorporated herein by reference.

BACKGROUND

The present disclosure relates to a waste ink storage mechanism which includes a waste ink tank for storing a waste ink exhausted from a recording head that discharges an ink to a recording medium such as a sheet and an inkjet recording device which includes such a waste ink storage mechanism.

As a recording device such as a facsimile, a copying machine or a printer, an inkjet recording device which discharges an ink so as to form an image is widely used because the inkjet recording device can form a high definition image.

In the inkjet recording device described above, for example, it is likely that the linearity of the ink is degraded (curved travel course) or the discharge thereof is prevented such that the printing performance of a recording head is lowered. As a cause of this problem, the occurrence of a meniscus abnormality can be considered, and the meniscus abnormality occurs because a foreign substance such as paper powder, dirt or dust produced when a sheet (recording medium) is transported, minute ink droplets (hereinafter referred to as a mist) discharged together with ink droplets for image recording or a mist scattered when the ink droplets are adhered to the recording medium is adhered to the ink discharge surface of a recording head. Moreover, as a cause of this problem, the lowering of sealing at the time of fitting of a cap as a result of a mist being adhered to a place where the cap is fitted so as to be dried and an increase in the viscosity of the ink within a nozzle resulting therefrom can also be considered.

Hence, a configuration is known in which in order to prevent the drying of the ink within a discharge nozzle where an opening is provided in the ink discharge surface of the recording head and the clogging of the nozzle resulting from an increase in the viscosity of the ink within the discharge nozzle, after the ink is forcefully pushed out (purged) from the nozzle, the purged ink adhered to the ink discharge surface (nozzle surface) is wiped away with a wiper and thus restoration processing on the recording head is performed.

A configuration is also known in which after a cleaning liquid is supplied to the ink discharge surface of the recording head, the ink discharge surface is wiped while the cleaning liquid is being held with the wiper and thus the restoration processing on the recording head is performed.

Since a waste ink is produced when the restoration processing described above is performed on the recording head, in the inkjet recording device, a waste ink tank for storing the waste ink is provided. When the waste ink tank is full, it is necessary to replace it with a new (empty) waste ink tank, and thus in the inkjet recording device, a detection sensor for detecting a liquid surface within the waste ink tank is provided. As the detection sensor, there are an electrode type, a float type and the like, and with consideration given to the exchangeability of the waste ink tank, the detection sensor is preferably installed outside the waste ink tank.

In the inkjet recording device described above, a configuration can be considered in which the detection sensor is arranged in a part of a waste ink tank fitting portion into which the waste ink tank is fitted on a downstream side (back side) in a direction of fitting of the waste ink tank, and in which in a side surface (back surface) of the waste ink tank on the downstream side in the direction of the fitting, an inflow port through which the waste ink flows in is provided. In this configuration, the waste ink tank is fitted into the waste ink tank fitting portion, and thus the downstream end of a waste ink passage path is coupled to the inflow port of the waste ink tank and the detection sensor is arranged close to the back surface of the waste ink tank.

SUMMARY

A waste ink storage mechanism according to a first aspect of the present disclosure includes a waste ink tank, a waste ink tank fitting portion and a capacitance sensor. The waste ink tank stores a waste ink exhausted from a recording head that discharges an ink on a recording medium. The waste ink tank is fitted to the waste ink tank fitting portion such that the waste ink tank can be fitted into and removed from the waste ink tank fitting portion. The capacitance sensor is provided in the waste ink tank fitting portion so as to detect that a liquid surface within the waste ink tank reaches a predetermined level. The waste ink tank includes: a first surface in which an inflow port through which the waste ink flows in is formed; and a second surface which is a side surface of the waste ink tank and which is different from the first surface. The capacitance sensor is arranged close to the second surface.

Further other objects of the present disclosure and specific advantages obtained by the present disclosure will become more apparent from the description of an embodiment given below.

DETAILED DESCRIPTION

An embodiment of the present disclosure will be described below with reference to drawings.

Figure 1:
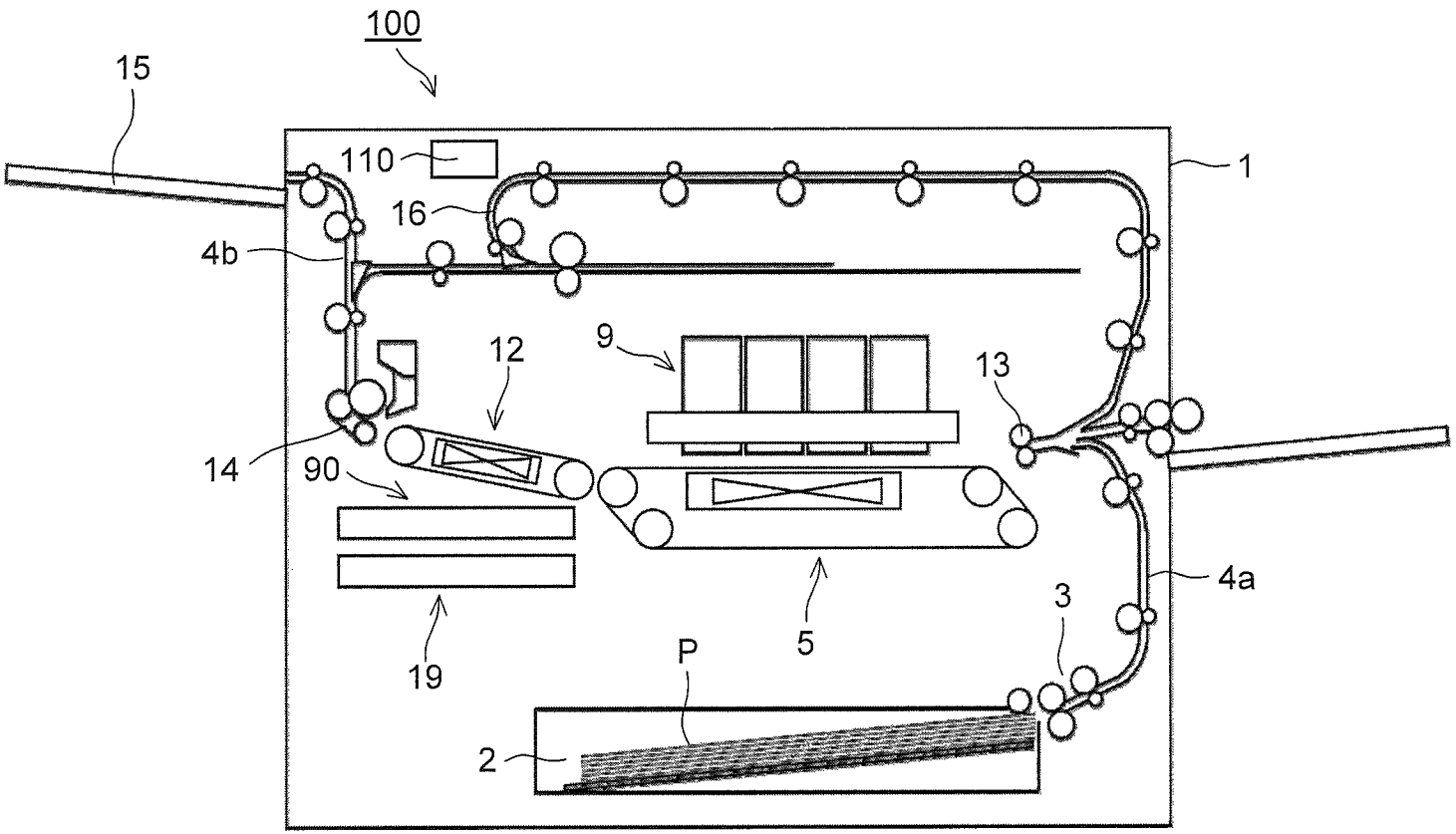
FIG. 1 is a diagram showing the structure of an inkjet recording device which includes a waste ink storage mechanism according to an embodiment of the present disclosure.

An inkjet recording device 100 according to the embodiment of the present disclosure will be described with reference to FIGS. 1 to 11. As shown in FIG. 1, in the inkjet recording device 100, a paper feed cassette 2 which is a sheet storage portion is arranged in a lower portion within a device main body 1. Within the paper feed cassette 2, sheets P which are an example of a recording medium are stored. On the downstream side of the paper feed cassette 2 in a sheet transport direction, that is, above the right side of the paper feed cassette 2 in FIG. 1, a paper feed device 3 is arranged. The sheets P are separated and fed one by one with the paper feed device 3 upward to the right of the paper feed cassette 2 in FIG. 1.

The inkjet recording device 100 also includes a first sheet transport path 4*a* therewithin. With respect to the paper feed cassette 2, the first sheet transport path 4*a* is located upward to the right in a paper feed direction. The sheet P fed out from the paper feed cassette 2 is transported with the first sheet transport path 4*a* upward along the side surface of the device main body 1.

At the downstream end of the first sheet transport path 4*a* in the sheet transport direction, a registration roller pair 13 is provided. Furthermore, on the downstream side of the registration roller pair 13 in the sheet transport direction, a first transport unit 5 and a recording portion 9 are arranged. The sheet P fed out from the paper feed cassette 2 reaches the registration roller pair 13 through the first sheet transport path 4*a*. The registration roller pair 13 feeds out the sheet P toward the first transport unit 5 while correcting the oblique feed of the sheet P and adjusting timing of an ink discharge operation performed by the recording portion 9.

On the downstream side (the left side of FIG. 1) of the first transport unit 5 in the sheet transport direction, a second transport unit 12 is arranged. The sheet P on which an ink image is recorded in the recording portion 9 is fed to the second transport unit 12, and an ink discharged on the surface of the sheet P is dried while the sheet P is being passed through the second transport unit 12.

On the downstream side of the second transport unit 12 in the sheet transport direction and in the vicinity of the left side surface of the device main body 1, a decurler portion 14 is provided. The sheet P in which the ink is dried in the second transport unit 12 is fed to the decurler portion 14, and a curl formed in the sheet P is corrected.

On the downstream side (upward of FIG. 1) of the decurler portion 14 in the sheet transport direction, a second sheet transport path 4*b* is provided. When double-sided recording is not performed, the sheet P which is passed through the decurler portion 14 is ejected from the second sheet transport path 4*b* to a sheet ejection tray 15 provided outside the left side surface of the inkjet recording device 100.

In an upper portion of the device main body 1 and above the recording portion 9 and the second transport unit 12, a reverse transport path 16 for performing the double-sided recording is provided. When the double-sided recording is performed, the sheet P in which recording on a first surface is completed and which is then passed through the second transport unit 12 and the decurler portion 14 is fed through the second sheet transport path 4*b* to the reverse transport path 16. Then, in the sheet P fed to the reverse transport path 16, the transport direction is switched for the recording of a second surface, and the sheet P is fed though the upper portion of the device main body 1 toward the right side, is passed through the first sheet transport path 4*a* and the registration roller pair 13 and is fed again to the first transport unit 5 in a state where the second surface is faced upward.

Below the second transport unit 12, a wipe unit 19 and a cap unit 90 are arranged. The wipe unit 19 is moved horizontally below the recording portion 9 when purge which will be described later is performed, wipes away the ink pushed out from the ink discharge ports of a recording head and collects the ink wiped away. The cap unit 90 is moved horizontally below the recording portion 9 when capping is performed on the ink discharge surface of the recording head, and is further moved upward so as to be fitted to the lower surface of the recording head.

Figure 2:
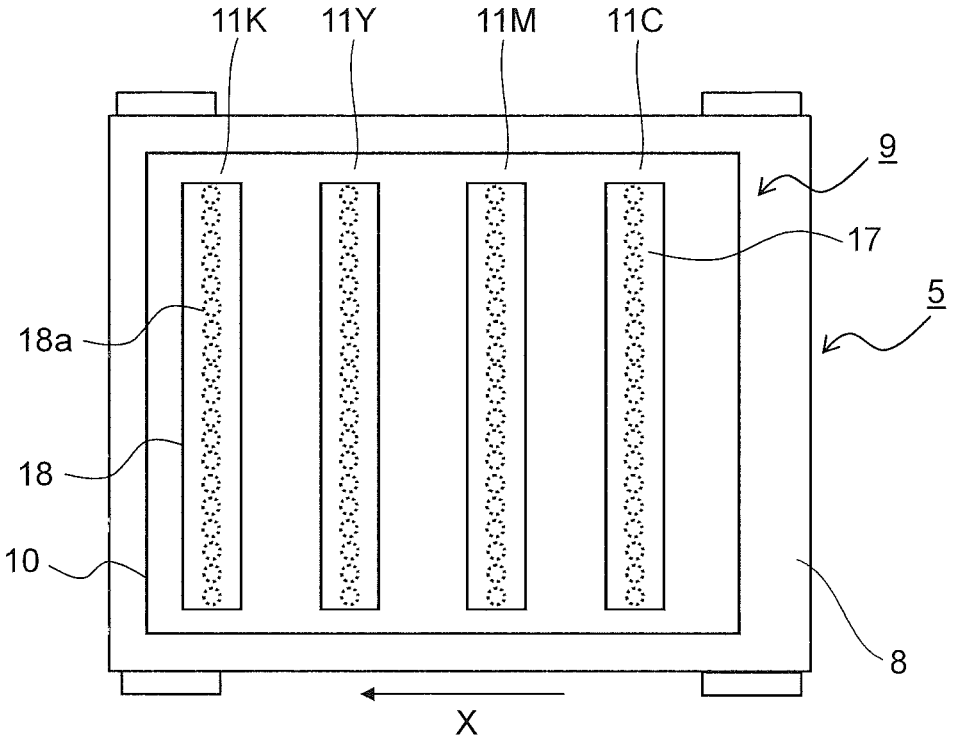
FIG. 2 is a diagram when a first transport unit and a recording portion in the inkjet recording device shown in FIG. 1 are seen from above.

As shown in FIG. 2, the recording portion 9 includes a head housing 10 and line heads 11C, 11M, 11Y and 11K held in the head housing 10. These line heads 11C to 11K are supported at such a height that a predetermined distance (for example, 1 mm) is formed with respect to the transport surface of a first transport belt 8 in the first transport unit 5, and are formed with one or more (here, one) recording heads 17 which are extended along a sheet width direction (the up/down direction of FIG. 2) orthogonal to the sheet transport direction (the direction of an arrow X).

Figure 3:
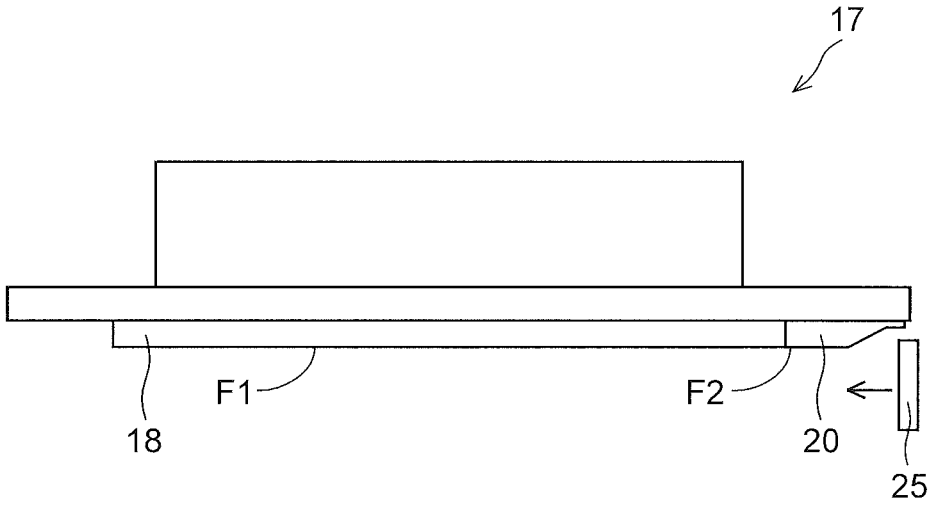
FIG. 3 is a diagram of a recording head which forms line heads in the recording portion.
Figure 4:
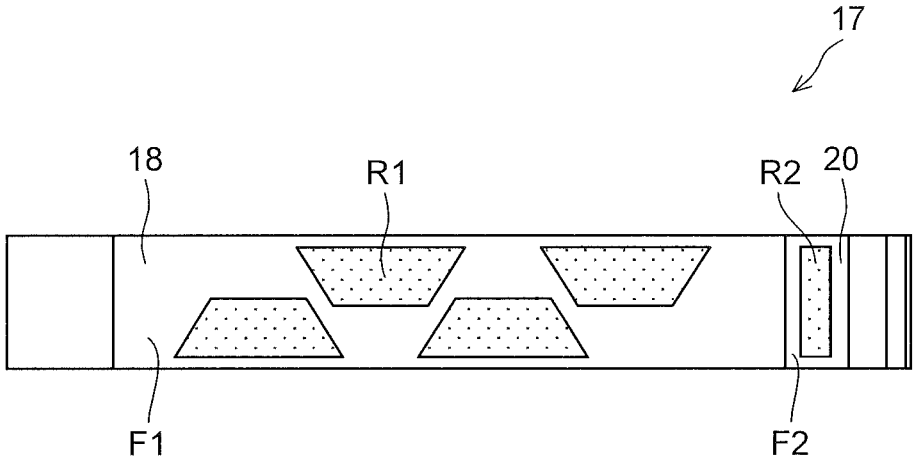
FIG. 4 is a diagram when the recording head is seen from the side of an ink discharge surface.

As shown in FIGS. 3 and 4, in the ink discharge surface F1 of a head portion 18 of the recording head 17, ink discharge regions R1 where a large number of ink discharge ports 18*a* (see FIG. 2) are aligned are provided.

The inks of four colors (cyan, magenta, yellow and black) which are stored in individual ink tanks (unillustrated) are supplied to the recording head 17 of the line heads 11C to 11K for the individual colors of the line heads 11C to 11K.

The recording head 17 discharges, according to image data received from an external computer by a control signal from a control portion 110 (see FIG. 1), the inks from the ink discharge ports 18*a* toward the sheet P which is adsorbed and held to the transport surface of the first transport belt 8 and which is transported. In this way, in the sheet P on the first transport belt 8, a color image in which the inks of the four colors of cyan, magenta, yellow and black are superimposed is formed.

In the recording head 17, a cleaning liquid supply member 20 is provided which supplies a cleaning liquid. The cleaning liquid supply member 20 is arranged adjacent to the upstream side (the right side of FIG. 3) of a wiper 25 in a wiping direction with respect to the head portion 18. The cleaning liquid supply member 20 has a cleaning liquid supply surface F2 which includes a cleaning liquid supply region R2 where a large number of cleaning liquid supply ports for supplying the cleaning liquid are aligned.

Figure 5:
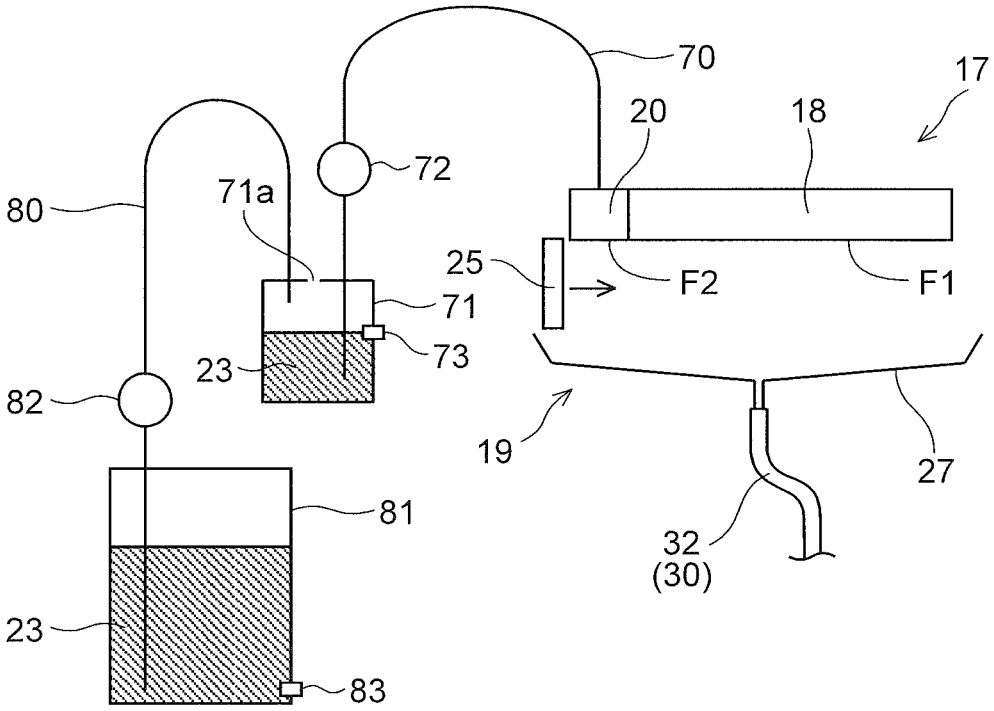
FIG. 5 is a diagram showing a configuration around the recording head, a sub-tank and a main tank.

As shown in FIG. 5, the downstream end of a cleaning liquid supply path 70 formed with a tube through which the cleaning liquid 23 is passed is connected to the cleaning liquid supply member 20. The upstream end of the cleaning liquid supply path 70 is connected to one sub-tank 71 where the cleaning liquid 23 which is supplied to the cleaning liquid supply member 20 is stored. In the cleaning liquid supply path 70, a supply pump 72 is provided which pumps up the cleaning liquid 23 from the sub-tank 71 so as to feed it to the cleaning liquid supply member 20. In FIG. 5, for ease of understanding, the cleaning liquid 23 is hatched.

The downstream end of a cleaning liquid replenishment path 80 formed with a tube through which the cleaning liquid 23 is passed is connected to the sub-tank 71. The upstream end of the cleaning liquid replenishment path 80 is connected to a main tank 81 where the cleaning liquid 23 which is replenished to the sub-tank 71 is stored. In the cleaning liquid replenishment path 80, a replenishment pump 82 is provided which pumps up the cleaning liquid 23 from the main tank 81 so as to feed it to the sub-tank 71.

In the sub-tank 71, an atmospheric release port 71*a* is provided which is used to make the pressure of an internal space equal to the atmospheric pressure. In a predetermined position of the sub-tank 71, a first detection sensor 73 is provided which detects the cleaning liquid 23. When the lack of the liquid is detected by the first detection sensor 73, until the liquid is detected, the cleaning liquid 23 is replenished by the replenishment pump 82 from the main tank 81 to the sub-tank 71. In this way, the liquid surface (upper surface) of the cleaning liquid 23 within the sub-tank 71 is maintained at a substantially constant height within the sub-tank 71.

In a lower portion of the main tank 81, a second detection sensor 83 is provided which detects the cleaning liquid 23. When the lack of the liquid is detected by the second detection sensor 83, information that the main tank 81 is empty is notified to a display panel (unillustrated) of the inkjet recording device 100. In this way, by a user or an operator, the main tank 81 is replaced with a new one or the cleaning liquid 23 is replenished to the main tank 81.

In the inkjet recording device 100 described above, in order for the ink discharge surface F1 of the recording head 17 to be cleaned, when printing is started after a stop for a long period of time or between printing operations, purge is performed in which the ink whose viscosity is increased is pushed out from the ink discharge ports 18*a* of the head portion 18, and the cleaning liquid 23 is supplied from the cleaning liquid supply ports (unillustrated) of the cleaning liquid supply member 20. Then, the cleaning liquid supply surface F2 and the ink discharge surface F1 are wiped with the wiper 25 of the wipe unit 19. Here, the waste ink and the waste cleaning liquid wiped away with the wiper 25 are collected in a collection tray 27 provided in the wipe unit 19 and are stored in the waste ink tank 40 of a waste ink storage mechanism 30 which will be described later. This restoration operation on the recording head 17 is performed based on the control signal from the control portion 110 (see FIG. 1) by control of the operations of the recording head 17, the wipe unit 19, the supply pump 72 and the like.

The waste ink storage mechanism 30 for storing the waste ink and the waste cleaning liquid will then be described.

Figure 6:
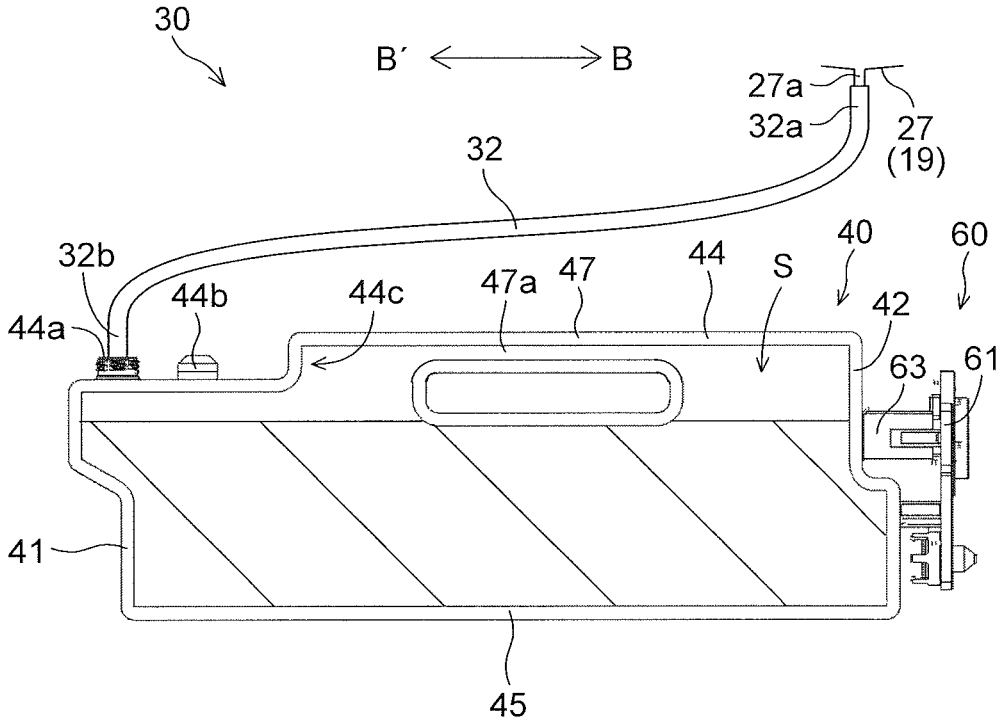
FIG. 6 is a diagram showing the structure of the waste ink storage mechanism according to the embodiment of the present disclosure.

As shown in FIG. 6, the waste ink storage mechanism 30 is formed with: the waste ink tank 40 in which the waste ink and the waste cleaning liquid are stored; a waste ink tank fitting portion 50 (see FIG. 8) into which the waste ink tank 40 is fitted such that the waste ink tank 40 can be fitted into and removed from the waste ink tank fitting portion 50; a capacitance sensor 60 which detects that a liquid surface within the waste ink tank 40 reaches a predetermined level; and a waste ink tube 32 through which the waste ink and the waste cleaning liquid are passed and which is connected to the waste ink tank 40. In FIG. 6, a waste liquid consisting of the waste ink and the waste cleaning liquid is hatched.

Figure 7:
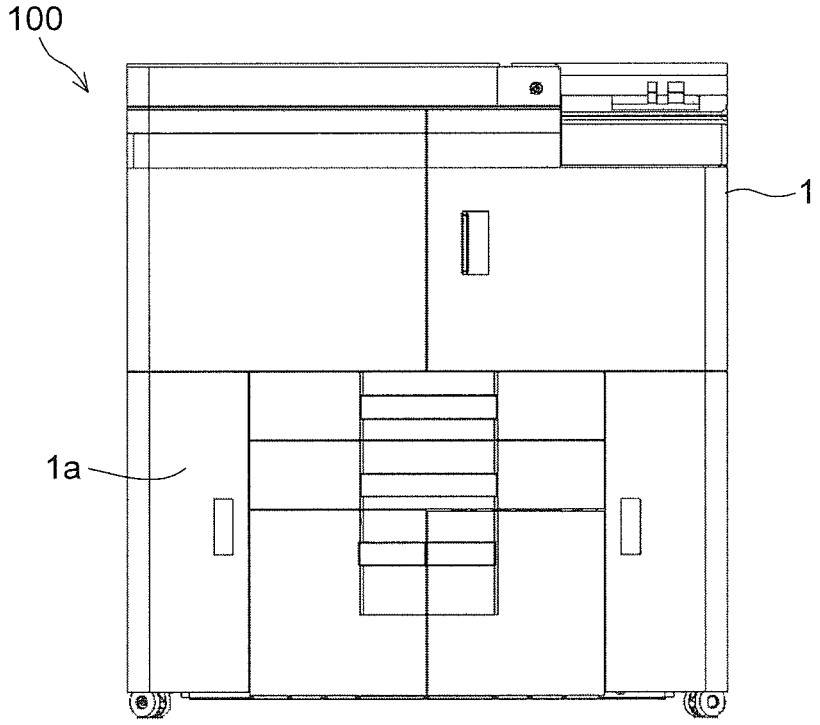
FIG. 7 is a diagram showing the appearance of the inkjet recording device shown in FIG. 1.
Figure 8:
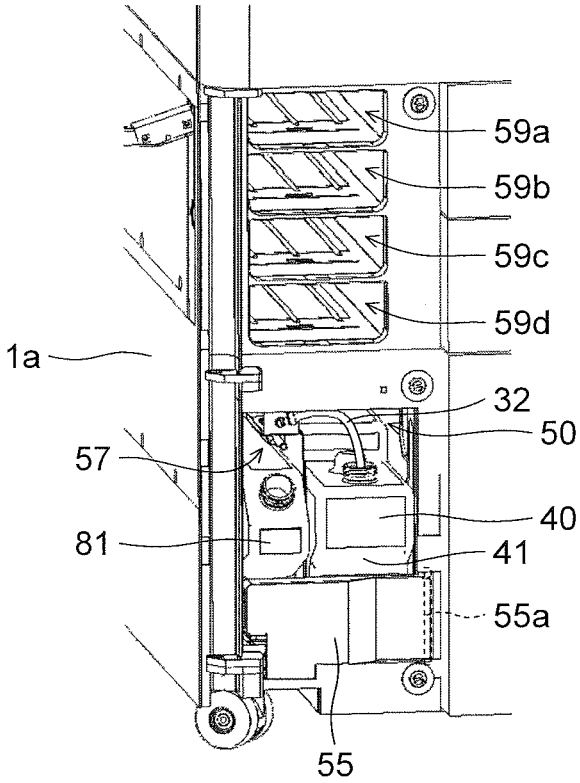
FIG. 8 is a diagram showing a structure around a waste ink tank fitting portion in the waste ink storage mechanism according to the embodiment of the present disclosure.

As shown in FIGS. 7 and 8, the waste ink tank fitting portion 50 is provided in a lower left portion of the device main body 1, and the front thereof is covered by an opening/closing cover 1*a* which forms a portion of the exterior cover of the device main body 1.

Inside the opening/closing cover 1*a*, the waste ink tank fitting portion 50, a main tank fitting portion 57 which is arranged adjacent to the waste ink tank fitting portion 50 and into which the main tank 81 for storing the cleaning liquid 23 is fitted and ink tank fitting portions 59*a* to 59*d* which are arranged above the waste ink tank fitting portion 50 and the main tank fitting portion 57 and into which the ink tanks (unillustrated) of the individual colors are fitted are provided. In the waste ink tank fitting portion 50, a tank cover 55 is provided which is arranged on the upstream side (the front side, that is, the front side with respect to the plane of FIG. 8) in a direction of fitting of the waste ink tank 40 and the main tank 81.

Figure 9:
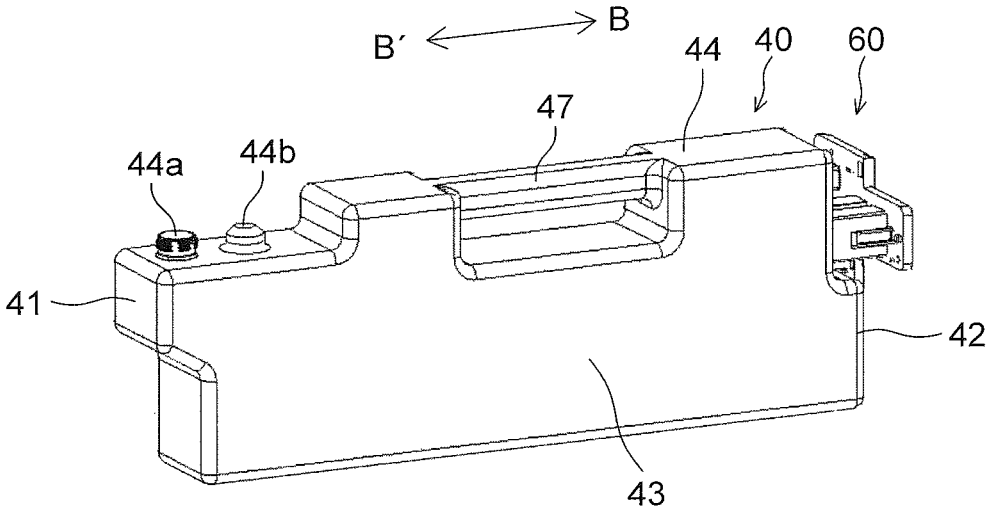
FIG. 9 is a diagram showing the structure of a waste ink tank and a capacitance sensor in the waste ink storage mechanism according to the embodiment of the present disclosure.

As shown in FIGS. 6 and 9, the waste ink tank 40 is formed in an elongated shape extending in forward/backward directions (vertical directions with respect to the plane of FIG. 7, that is, the directions of arrows BB'), and includes a front surface (a side surface on the upstream side in the direction of the fitting (the direction of the arrow B)) 41, a back surface (a side surface on the downstream side in the direction of the fitting) 42, a pair of side surfaces 43, an upper surface 44 and a lower surface 45. Within the waste ink tank 40, a storage chamber S is formed in which the waste ink and the waste cleaning liquid are stored.

The capacitance sensor 60 is arranged close to the back surface (second surface) 42.

In a part of the upper surface (first surface) 44 in the vicinity of the front surface 41, an inflow port 44*a* is formed through which the waste ink and the waste cleaning liquid flow in. In other words, the inflow port 44*a* is formed at an end portion on a side opposite to the back surface 42 in the directions of fitting and removal of the waste ink tank 40 (the directions of the arrows BB'). In the vicinity of the inflow port 44*a* in the upper surface 44, a cap placement portion 44*b* is formed which is used for placing a cap (unillustrated) covering the inflow port 44*a* when the waste ink tank 40 is replaced.

On the upper surface 44, between the inflow port 44*a* and the back surface 42, a step portion 44*c* is formed which projects upward from the inflow port 44*a* toward the back surface 42.

In the center portion of the upper surface 44 in the forward/backward directions (the directions of the arrows BB'), a grasping portion 47 is provided. In the grasping portion 47, a communication portion 47*a* is formed through which air can be passed and which makes the storage chamber S communicate in the forward/backward directions.

Figure 10:
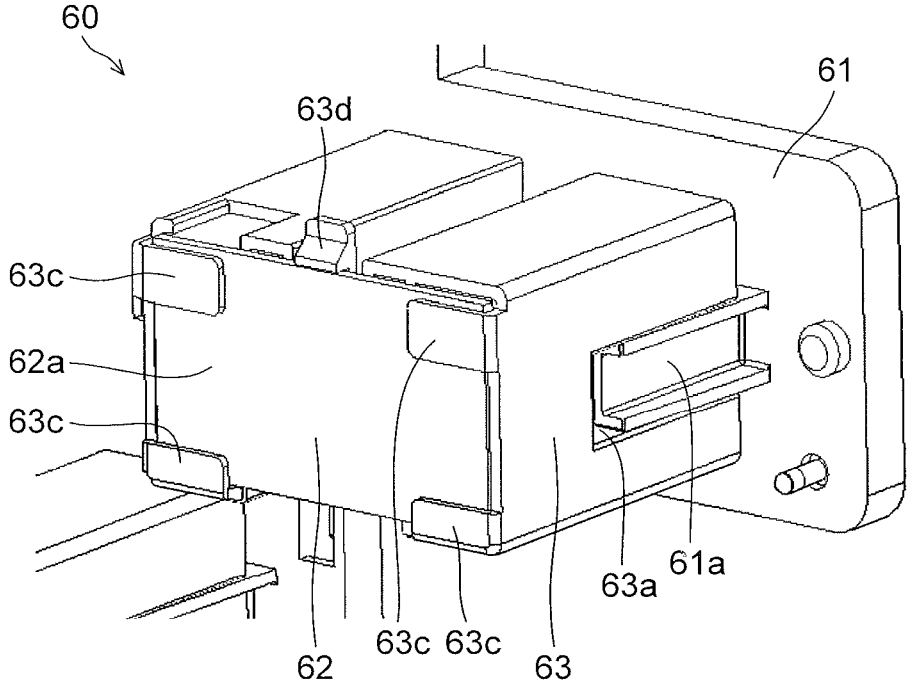
FIG. 10 is a diagram showing the structure of the capacitance sensor in the waste ink storage mechanism according to the embodiment of the present disclosure.
Figure 11:
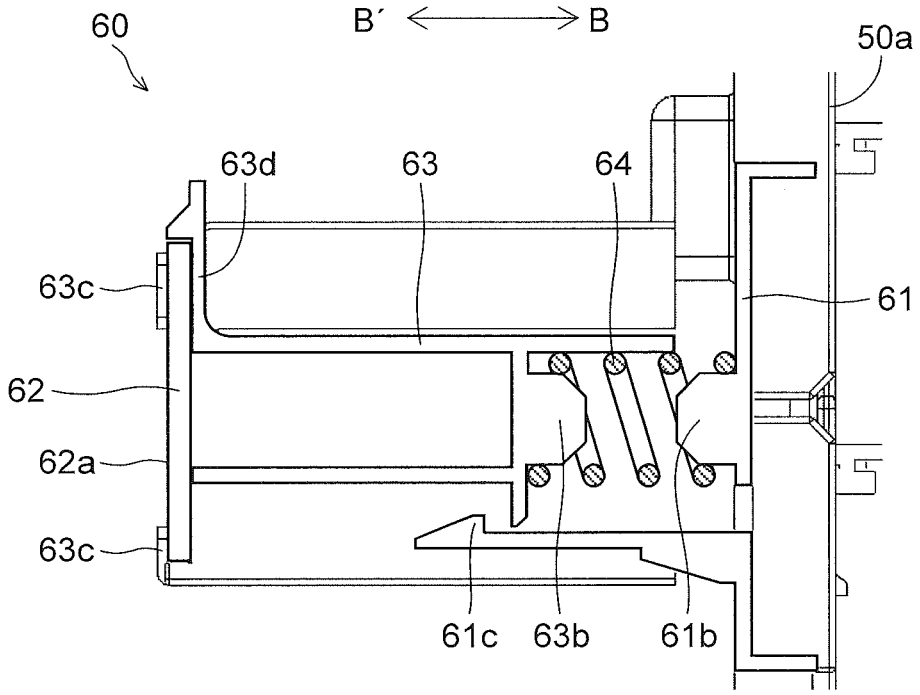
FIG. 11 is a diagram showing the structure of the capacitance sensor in the waste ink storage mechanism according to the embodiment of the present disclosure.

The capacitance sensor 60 is provided on the downstream side in the direction of fitting of the waste ink tank 40 in the waste ink tank fitting portion 50 (see FIG. 8). As shown in FIGS. 10 and 11, the capacitance sensor 60 is formed with: a fixing portion 61 which is located and fixed to the frame 50*a* of the waste ink tank fitting portion 50; an electrode portion 62 which detects that the liquid surface (liquid amount) within the waste ink tank 40 reaches the predetermined level; a holding portion 63 which holds the electrode portion 62 and which slides in the forward/backward directions (the directions of the arrows BB') with respect to the fixing portion 61; and a biasing member 64 which biases the holding portion 63 toward the back surface 42 of the waste ink tank 40.

In the fixing portion 61, a pair of guide portions 61*a* which are extended in the forward/backward directions (the directions of the arrows BB'), a boss 61*b* to which one end of the biasing member 64 is attached and a regulation portion 61*c* which regulates the movement of the holding portion 63 in the forward direction (the direction of the arrow B') are formed.

In the side surfaces of the holding portion 63, a pair of concave sliding portions 63*a* are formed which are extended in the forward/backward directions (the directions of the arrows BB') and which slide with respect to the guide portions 61*a*. In the holding portion 63, a boss 63*b* to which the other end of the biasing member 64 is attached is formed in a part opposite the boss 61*b* of the fixing portion 61.

In the front end portion (the left end portion of FIG. 11) of the holding portion 63, four engagement hooks 63*c* which engage with an edge portion of a detection surface 62*a* of the electrode portion 62 and a sandwich portion 63*d* which sandwich the electrode portion 62 together with the engagement hooks 63*c* so as to hold the electrode portion 62 and which can be elastically deformed are formed. In a state where the waste ink tank 40 is fitted into the waste ink tank fitting portion 50 (the state of FIG. 6), the engagement hooks 63*c* of the holding portion 63 are pressed by the back surface 42 (see FIG. 6) of the waste ink tank 40. Hence, the distance from the detection surface 62*a* of the electrode portion 62 to the waste ink tank 40 is held constant.

The electrode portion 62 is formed such that its length in a width direction (a vertical direction with respect to the plane of FIG. 6) is equal to or more than the length of the storage chamber S of the waste ink tank 40 in a width direction. The capacitance sensor 60 can detect, within a range of the height of the electrode portion 62, that the liquid surface within the waste ink tank 40 reaches the predetermined level, and transmits the result of the detection to the control portion 110.

As shown in FIG. 6, the waste ink tube 32 is arranged from a position of the waste ink tank fitting portion 50 (see FIG. 8) on the downstream side (the right side of FIG. 6) in the direction of the fitting to a position on the upstream side (the left side of FIG. 6) in the direction of the fitting. Specifically, the exhaust port 27*a* of the collection tray 27 in the wipe unit 19 is arranged on the downstream side of the waste ink tank fitting portion 50 in the direction of the fitting. The upstream end 32*a* of the waste ink tube 32 is connected to the exhaust port 27*a*, and the downstream end 32*b* thereof is drawn to the upstream side of the waste ink tank fitting portion 50 in the direction of the fitting and is inserted into (connected to) the inflow port 44*a* of the waste ink tank 40.

As shown in FIG. 8, the tank cover 55 is formed so as to be able to turn about a turning shaft 55*a*. In a state where the tank cover 55 is closed (the state of FIG. 8), the tank cover 55 abuts on the front surface 41 of the waste ink tank 40 and the front surface of the main tank 81, the waste ink tank 40 is arranged in a predetermined position of the waste ink tank fitting portion 50 and the main tank 81 is arranged in a predetermined position of the main tank fitting portion 57. Then, as shown in FIG. 6, the holding portion 63 of the capacitance sensor 60 abuts on the back surface 42 of the waste ink tank 40.

In the inkjet recording device 100, when the liquid surface within the waste ink tank 40 reaches a predetermined position (for example, the position of FIG. 6), information that the waste ink tank 40 is empty is notified to the display panel (unillustrated) of the inkjet recording device 100. In this way, by the user or the operator, the waste ink tank 40 is replaced with a new one.

Specifically, by the user or the operator, the opening/closing cover 1*a* and the tank cover 55 (see FIG. 8 for them) are opened, and the downstream end 32*b* of the waste ink tube 32 is pulled out (removed) from the inflow port 44*a* of the waste ink tank 40. Then, the waste ink tank 40 is pulled out from the waste ink tank fitting portion 50.

Thereafter, the new (empty) waste ink tank 40 is fitted into the waste ink tank fitting portion 50, and the downstream end 32*b* of the waste ink tube 32 is inserted into the inflow port 44*a* of the waste ink tank 40. Then, the tank cover 55 is closed so as to fit the waste ink tank 40 into the predetermined position of the waste ink tank fitting portion 50, with the result that the capacitance sensor 60 abuts on the back surface 42 of the waste ink tank 40. Thereafter, the opening/closing cover 1*a* is closed, and the replacement operation of the waste ink tank 40 is completed.

In the present embodiment, as described above, the waste ink tank 40 includes the upper surface 44 where the inflow port 44*a* through which the waste liquid (the waste ink and cleaning liquid) flows in is formed and the back surface 42, and the capacitance sensor 60 is arranged close to the back surface 42. In this way, it is possible to reduce the occurrence of a problem that the waste liquid flowing in through the inflow port 44*a* is passed along the back surface 42 to which the capacitance sensor 60 is arranged close and is made to flow down. Hence, it is possible to reduce the occurrence of a problem that when the waste liquid is not stored so as to reach the height of the capacitance sensor 60, the capacitance sensor 60 erroneously detects the waste liquid. Consequently, with the capacitance sensor 60, it is possible to highly accurately detect that the liquid surface within the waste ink tank 40 reaches the predetermined level.

As described above, the inflow port 44*a* is formed in the part on the side opposite to the back surface 42 of the upper surface 44 in the directions of the fitting and removal (the directions of the arrows BB'). In this way, the inflow port 44*a* can be arranged away from the back surface 42, and thus it is possible to reduce the occurrence of the problem that the waste liquid flowing in through the inflow port 44*a* is passed along the back surface 42 and is made to flow down.

Since as described above, the upstream end 32*a* of the waste ink tube 32 (that is, the exhaust port 27*a* of the collection tray 27 connected to the waste ink tube 32) is arranged in the position of the waste ink tank fitting portion 50 on the downstream side in the direction of the fitting, even when the inflow port 44*a* is formed in the part of the waste ink tank 40 on the upstream side in the direction of the fitting, the waste ink tube 32 is used, and thus it is possible to easily guide the waste liquid exhausted from the recording head 17 to the inflow port 44*a* of the waste ink tank 40.

The inflow port 44*a* is formed in the part of the upper surface 44 on the upstream side in the direction of the fitting, and thus when the waste ink tank 40 is replaced, the waste ink tube 32 is easily removed from the inflow port 44*a*.

As described above, on the upper surface 44, between the inflow port 44*a* and the back surface 42, the step portion 44*c* is formed which projects upward from the inflow port 44*a* toward the back surface 42. In this way, even when the waste liquid flowing in through the inflow port 44*a* is passed along the upper surface 44 and is made to flow in the direction of the back surface 42, the waste liquid is prevented by the step portion 44*c* from flowing in the direction of the back surface 42. In other words, with the step portion 44*c*, it is possible to stop the flow of the waste liquid. Hence, it is possible to prevent the waste liquid from being passed along the back surface 42 and made to flow down.

As described above, the capacitance sensor 60 includes the holding portion 63 which holds the electrode portion 62 and which slides in the directions of the fitting and removal with respect to the fixing portion 61 and the biasing member 64 which biases the holding portion 63 toward the back surface 42. In this way, in the state where the waste ink tank 40 is fitted into the waste ink tank fitting portion 50, the distance between the electrode portion 62 and the waste ink tank 40 can be constantly held constant. Hence, it is possible to enhance the accuracy of detection of the capacitance sensor 60.

As described above, in the state where the tank cover 55 is closed, the tank cover 55 abuts on the front surface 41 of the waste ink tank 40, the waste ink tank 40 is arranged in the predetermined position of the waste ink tank fitting portion 50 and the capacitance sensor 60 abuts on the back surface 42. In this way, after the replacement of the waste ink tank 40, the tank cover 55 is closed, and thus the waste ink tank 40 can be reliably arranged in the predetermined position of the waste ink tank fitting portion 50, and the capacitance sensor 60 can be reliably made to abut on the back surface 42.

The embodiment disclosed here should be considered to be illustrative in all respects and not restrictive. The scope of the present disclosure is indicated not by the description of the above embodiment but by the scope of claims, and includes meanings equivalent to the scope of claims and all modifications within the scope.

For example, although in the embodiment discussed above, the example where the inflow port 44*a* is formed in the upper surface 44 is described, the present disclosure is not limited to this example. The inflow port 44*a* may be formed in the side surface 43. In this case, the inflow port 44*a* is preferably formed in a part of the side surface 43 on the side opposite to the back surface 42.

Figure 12:
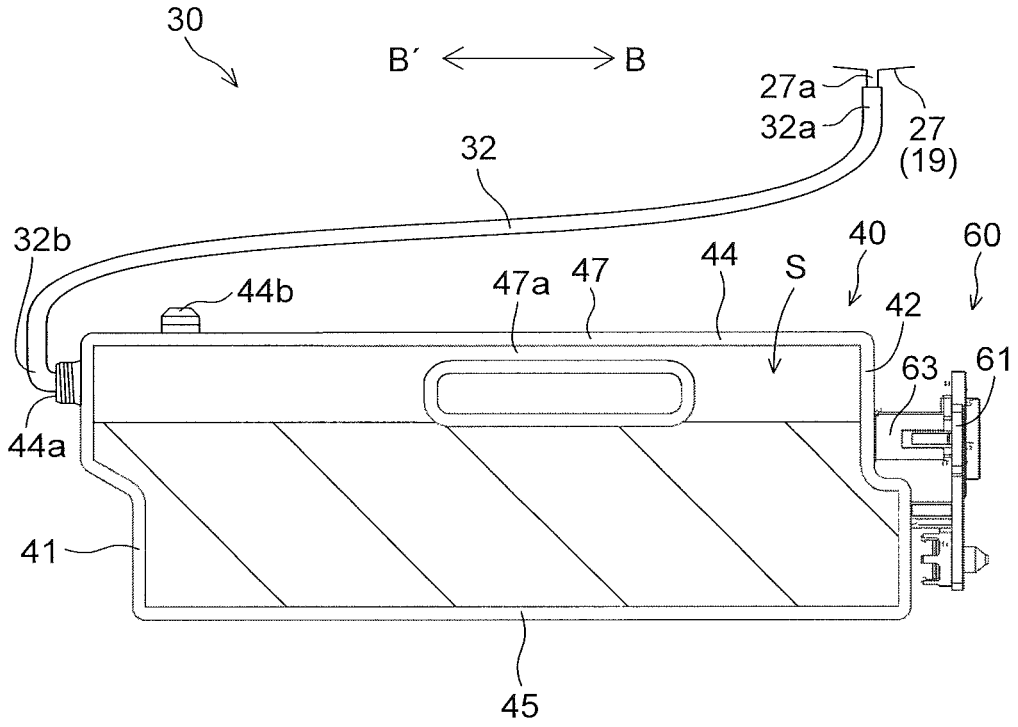
FIG. 12 is a diagram showing the structure of a waste ink storage mechanism according to a variation of the present disclosure.

As in a waste ink storage mechanism 30 of a variation of the present disclosure shown in FIG. 12, the inflow port 44*a* may be formed in the front surface 41 (the side surface opposite to the back surface 42). In this case, as in the embodiment described above, the inflow port 44*a* can be arranged away from the back surface 42, and thus it is possible to reduce the occurrence of the problem that the waste liquid flowing in through the inflow port 44*a* is passed along the back surface 42 and is made to flow down. Since the upstream end 32*a* of the waste ink tube 32 (that is, the exhaust port 27*a* of the collection tray 27 connected to the waste ink tube 32) is arranged in the position of the waste ink tank fitting portion 50 on the downstream side in the direction of the fitting, even when the inflow port 44*a* is formed in the part (the front surface 41) of the waste ink tank 40 on the upstream side in the direction of the fitting, the waste ink tube 32 is used, and thus it is possible to easily guide the waste liquid exhausted from the recording head 17 to the inflow port 44*a* of the waste ink tank 40.

Although in the embodiment discussed above, the example where the cleaning liquid 23 is used so as to perform the restoration operation on the recording head 17 and where the waste ink and the waste cleaning liquid are stored in the waste ink tank 40 is described, the present disclosure is not limited to this example. Specifically, a configuration may be adopted where after the purge in which the ink is pushed out from the ink discharge ports 18*a* is performed, the ink discharge surface F1 is wiped with the wiper 25 such that the restoration operation is performed on the recording head 17 and where only the waste ink is stored in the waste ink tank 40.

What is claimed is:

1. A waste ink storage mechanism comprising:

a waste ink tank which stores a waste ink exhausted from a recording head that discharges an ink on a recording medium;

a waste ink tank fitting portion into which the waste ink tank is fitted such that the waste ink tank can be fitted into and removed from the waste ink tank fitting portion; and a capacitance sensor which is provided in the waste ink tank fitting portion so as to detect that a liquid surface within the waste ink tank reaches a predetermined level, wherein the waste ink tank includes: a first surface in which an inflow port through which the waste ink flows in is formed; and a second surface which is a side surface of the waste ink tank and which is different from the first surface, the capacitance sensor is arranged close to the second surface, a concave portion is provided in an upper surface of the waste ink tank, a grasping portion is provided in the concave portion, both ends of the grasping portion are connected to the concave portion, a storage chamber for storing the waste ink is formed inside the waste ink tank, a communication portion that communicates with the storage chamber is formed in the grasping portion, and the capacitance sensor is arranged at a same height as a bottom surface of the concave portion.

2. The waste ink storage mechanism according to claim 1, wherein the first surface is an upper surface or a side surface of the waste ink tank adjacent to the second surface, and the inflow port is formed in a part of the first surface on a side opposite to the second surface in directions of the fitting and removal of the waste ink tank.

3. The waste ink storage mechanism according to claim 2, further comprising:

a waste ink tube through which the waste ink exhausted from the recording head is passed and which is connected to the inflow port, wherein the inflow port is formed in a part of the first surface on an upstream side in the direction of the fitting, the second surface is a side surface of the waste ink tank on the downstream side in the direction of the fitting, and the waste ink tube is arranged from a position of the waste ink tank fitting portion on the downstream side in the direction of the fitting to a position on the upstream side in the direction of the fitting.

4. The waste ink storage mechanism according to claim 1, wherein the first surface is an upper surface of the waste ink tank, on the upper surface, between the inflow port and the second surface, a step portion is formed which projects upward from the inflow port toward the second surface, and a position of the grasping portion is higher than a position of the inflow port.

5. The waste ink storage mechanism according to claim 1, wherein the first surface is a side surface of the waste ink tank opposite the second surface.

6. The waste ink storage mechanism according to claim 5, further comprising:

a waste ink tube through which the waste ink exhausted from the recording head is passed and which is connected to the inflow port, wherein the first surface is a side surface of the waste ink tank on an upstream side in a direction of the fitting, the second surface is a side surface of the waste ink tank on a downstream side in the direction of the fitting and the waste ink tube is arranged from a position of the waste ink tank fitting portion on the downstream side in the direction of the fitting to a position on the upstream side in the direction of the fitting.

7. The waste ink storage mechanism according to claim 1, wherein the capacitance sensor includes:

a fixing portion which is fixed to the waste ink tank fitting portion;

an electrode portion which detects that the liquid surface within the waste ink tank reaches the predetermined level;

a holding portion which holds the electrode portion and which slides in directions of the fitting and removal with respect to the fixing portion; and a biasing member which biases the holding portion toward the second surface.

8. The waste ink storage mechanism according to claim 7, further comprising:

a tank cover which is arranged on an upstream side in the direction of the fitting of the waste ink tank, wherein in a state where the tank cover is closed, the tank cover abuts on a side surface of the waste ink tank on the upstream side in the direction of the fitting, the waste ink tank is arranged in a predetermined position of the waste ink tank fitting portion and the capacitance sensor abuts on the second surface.

9. An inkjet recording device comprising:

the waste ink storage mechanism according to claim 1; and the recording head which discharges the ink on the recording medium.

10. A waste ink storage mechanism comprising:

a waste ink tank which stores a waste ink exhausted from a recording head that discharges an ink on a recording medium;

a waste ink tank fitting portion into which the waste ink tank is fitted such that the waste ink tank can be fitted into and removed from the waste ink tank fitting portion;

a capacitance sensor which is provided in the waste ink tank fitting portion so as to detect that a liquid surface within the waste ink tank reaches a predetermined level; and a waste ink tube through which the waste ink exhausted from the recording head is passed and which is connected to the inflow port, wherein the waste ink tank includes: a first surface in which an inflow port through which the waste ink flows in is formed; and a second surface which is a side surface of the waste ink tank and which is different from the first surface, and the capacitance sensor is arranged close to the second surface, the first surface is a side surface of the waste ink tank opposite the second surface, the first surface is a side surface of the waste ink tank on an upstream side in a direction of the fitting, the second surface is a side surface of the waste ink tank on a downstream side in the direction of the fitting and the waste ink tube is arranged from a position of the waste ink tank fitting portion on the downstream side in the direction of the fitting to a position on the upstream side in the direction of the fitting.

11. A waste ink storage mechanism comprising:

a waste ink tank which stores a waste ink exhausted from a recording head that discharges an ink on a recording medium;

a waste ink tank fitting portion into which the waste ink tank is fitted such that the waste ink tank can be fitted into and removed from the waste ink tank fitting portion; and a capacitance sensor which is provided in the waste ink tank fitting portion so as to detect that a liquid surface within the waste ink tank reaches a predetermined level, wherein the waste ink tank includes: a first surface in which an inflow port through which the waste ink flows in is formed; and a second surface which is a side surface of the waste ink tank and which is different from the first surface, the capacitance sensor is arranged close to the second surface, the capacitance sensor includes:

a fixing portion which is fixed to the waste ink tank fitting portion;

an electrode portion which detects that the liquid surface within the waste ink tank reaches the predetermined level;

a holding portion which holds the electrode portion and which slides in directions of the fitting and removal with respect to the fixing portion; and a biasing member which biases the holding portion toward the second surface, and the biasing member is arranged between the fixing portion and the holding portion.

* * * * *